US011047576B2

(12) United States Patent
Greenfield et al.

(10) Patent No.: US 11,047,576 B2
(45) Date of Patent: Jun. 29, 2021

(54) COMBUSTION LINERS AND ATTACHMENTS FOR ATTACHING TO NOZZLES

(71) Applicant: Delavan Inc., West Des Moines, IA (US)

(72) Inventors: Jacob Greenfield, Granger, IA (US); Thomas J. Ocken, Des Moines, IA (US); Jason A. Ryon, Carlisle, IA (US)

(73) Assignee: Delavan, Inc., West Des Moines, IA (US)

( * ) Notice: Subject to any disclaimer, the term of this patent is extended or adjusted under 35 U.S.C. 154(b) by 975 days.

(21) Appl. No.: 15/472,940

(22) Filed: Mar. 29, 2017

(65) Prior Publication Data

US 2018/0283694 A1 Oct. 4, 2018

(51) Int. Cl.
*F23R 3/60* (2006.01)
*F23R 3/28* (2006.01)
*F23R 3/00* (2006.01)

(52) U.S. Cl.
CPC ..... *F23R 3/60* (2013.01); *F23R 3/002* (2013.01); *F23R 3/283* (2013.01); *F23R 2900/00005* (2013.01)

(58) Field of Classification Search
CPC .. F02C 7/20; F05D 2230/64; F05D 2230/644; F23R 3/002; F23R 3/60; F23R 3/283; F23R 2900/00005
See application file for complete search history.

(56) References Cited

U.S. PATENT DOCUMENTS

| | | | | |
|---|---|---|---|---|
| 4,180,972 | A * | 1/1980 | Herman | F23R 3/60 60/751 |
| 4,512,159 | A | 4/1985 | Memmen | |
| 4,848,089 | A | 7/1989 | Cramer | |
| 5,201,799 | A | 4/1993 | Johnson | |
| 5,222,358 | A * | 6/1993 | Chaput | F23R 3/283 60/740 |
| 5,265,411 | A | 11/1993 | Belsom | |
| 5,337,583 | A | 8/1994 | Giles et al. | |
| 6,347,508 | B1 | 2/2002 | Smallwood et al. | |
| 7,900,461 | B2 * | 3/2011 | Varney | F01D 25/243 60/752 |
| 8,226,366 | B2 * | 7/2012 | Brucher | F01D 5/3015 416/221 |

(Continued)

FOREIGN PATENT DOCUMENTS

| | | |
|---|---|---|
| EP | 0078630 A2 | 5/1983 |
| EP | 1172611 A1 | 1/2002 |
| EP | 1439350 A2 | 7/2004 |

OTHER PUBLICATIONS

Extended European Search Report of the European Patent Office, dated Jul. 25, 2018, in corresponding European Patent Application No. 18164414.7.

*Primary Examiner* — Gerald L Sung
*Assistant Examiner* — Sean V Meiller
(74) *Attorney, Agent, or Firm* — Locke Lord LLP; Scott D. Wofsy; Gabrielle L. Gelozin

(57) ABSTRACT

An assembly for a turbomachine can include a fuel nozzle and a combustion liner. The fuel nozzle and the combustion liner can be attached to each using a plurality of clip joints such that the combustion liner is longitudinally fixed relative to the fuel nozzle but such that the combustion liner can radially move relative to the fuel nozzle.

12 Claims, 4 Drawing Sheets

(56) References Cited

U.S. PATENT DOCUMENTS

| | | | | |
|---|---|---|---|---|
| 9,297,266 | B2 | 3/2016 | Adair et al. | |
| 9,410,703 | B2 * | 8/2016 | Bunel | F23R 3/14 |
| 10,197,278 | B2 * | 2/2019 | Bloom | F23R 3/50 |
| 10,309,654 | B2 * | 6/2019 | Kamoi | F23R 3/002 |
| 2008/0016874 | A1 | 1/2008 | Markarian et al. | |
| 2014/0093370 | A1 | 4/2014 | Mattia et al. | |
| 2015/0354820 | A1 | 12/2015 | Vetters | |
| 2016/0245518 | A1 | 8/2016 | Drake | |
| 2017/0268783 | A1 * | 9/2017 | Cihlar | F23R 3/283 |
| 2018/0187889 | A1 * | 7/2018 | Mulcaire | F23R 3/283 |
| 2018/0216825 | A1 * | 8/2018 | Patel | F23R 3/005 |
| 2018/0347816 | A1 * | 12/2018 | Dziech | F23R 3/60 |
| 2019/0003711 | A1 * | 1/2019 | Reynolds | F23R 3/60 |
| 2019/0203649 | A1 * | 7/2019 | Thomas | F02C 7/20 |

* cited by examiner

Fig. 3
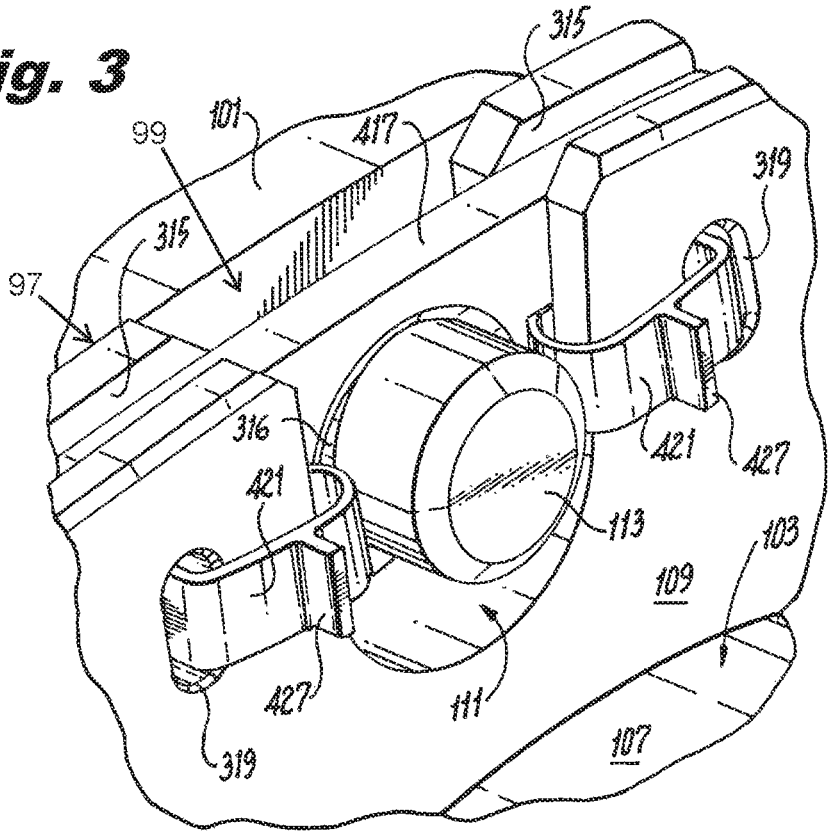
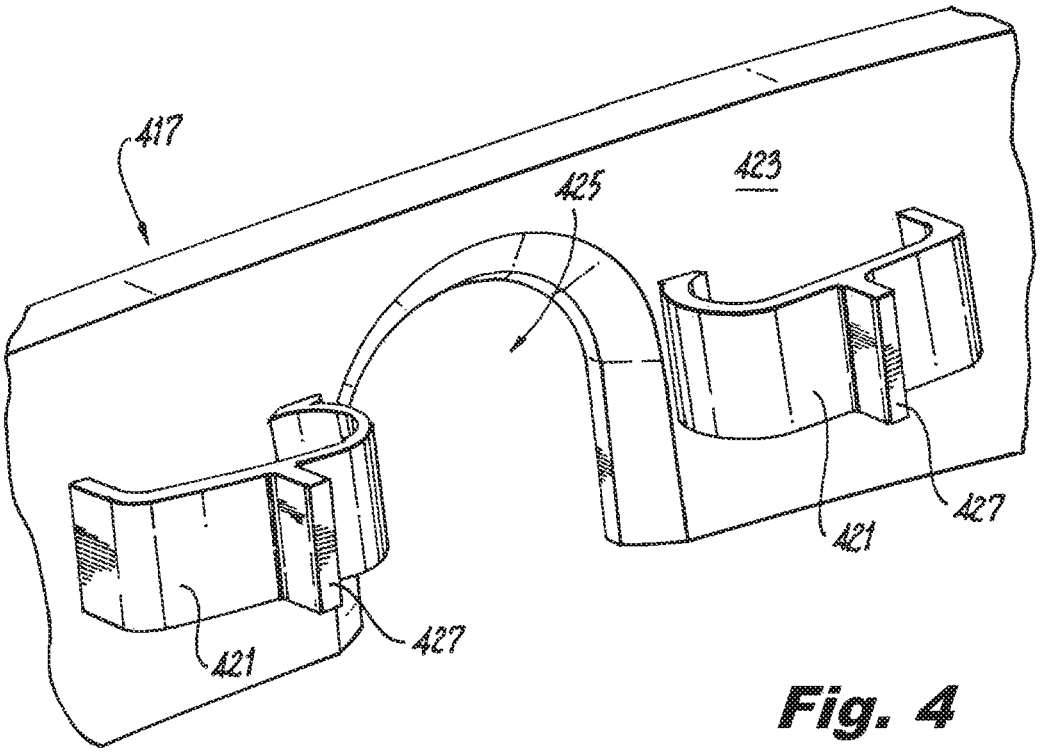
Fig. 4

COMBUSTION LINERS AND ATTACHMENTS FOR ATTACHING TO NOZZLES

BACKGROUND

1. Field

The present disclosure relates to turbomachines, more specifically to combustion liners for turbomachines.

2. Description of Related Art

Typically the combustion liners for turbomachines are attached to the engine case or other support structure, not directly to the nozzle. Using traditional threaded joints to attach the liner to the nozzle requires many joints (e.g., 30 threaded joints with 2 nuts on each joint for anti-rotation purposes). This creates a sizable amount of nuts to torque in a very tight space, which leaves room for mistake and is also time consuming.

Such conventional methods and systems have generally been considered satisfactory for their intended purpose. However, there is still a need in the art for improved combustion liners and attachments for attaching to nozzles. The present disclosure provides a solution for this need.

SUMMARY

In accordance with at least one aspect of this disclosure, an assembly for a turbomachine can include a fuel nozzle and a combustion liner. The fuel nozzle and the combustion liner can be attached to each using a plurality of clip joints such that the combustion liner is longitudinally fixed relative to the fuel nozzle but such that the combustion liner can radially move relative to the fuel nozzle.

In certain embodiments, the combustion liner for a turbomachine can include a body, and a flange extending from the body and configured to abut a fuel nozzle of a turbomachine. The flange can include a plurality of protrusion openings configured to receive a protrusion extending from the nozzle, and a slot defined at least partially circumferentially in an outer radius of the flange, the slot configured to receive a clip that is configured to interact with the protrusion to retain the flange longitudinally to the nozzle but to allow radial growth of the flange.

The assembly can include the clip disposed in the slot and in connection with the protrusion. The combustion liner can include a retainer aperture configured to receive a retainer of the clip to retain the clip to the combustion liner.

The clip can include a retaining feature configured to removably engage with the retainer aperture. The retainer aperture can be defined in the flange and/or in any other suitable location.

The clip can include a U-channel configured to receive the protrusion. The protrusion can include a bolt having a groove defined therein for interacting with the U-channel of the clip.

In certain embodiments, the combustion liner can include a body and a first flange extending from the body and configured to abut a fuel nozzle of a turbomachine. The first flange can include a plurality of protrusion openings configured to receive a protrusion extending from the nozzle. The liner can include a second flange extending at least partially longitudinally from the first flange to define a pocket between the second flange and the body, wherein the second flange includes a plurality of clip openings configured to allow a clip to be inserted into the pocket through each clip opening to interact with the protrusion to longitudinally retain the combustion liner to the fuel nozzle. The assembly can include the clip, wherein the clip includes a compressible shape such that the clip can fit through each clip opening in a compressed state and retains the clip in the pocket in the released state.

In accordance with at least one aspect of this disclosure, a combustion liner for a turbomachine can include any suitable features, e.g., as described above. It is contemplated that the features of a combustion liner can be included in the fuel nozzle and/or reversed with those of the fuel nozzle as appreciated by those having ordinary skill in the art.

In accordance with at least one aspect of this disclosure, a removable fastener for a combustion liner and fuel nozzle assembly can include a fastener body configured to fit within a slot of a combustion liner flange or a nozzle and a channel configured to receive a protrusion connected to the nozzle or the combustion liner to retain the combustion liner to the nozzle such that the combustion liner is longitudinally fixed relative to the fuel nozzle but such that the combustion liner can radially move relative to the fuel nozzle. The channel can include a U-channel.

The removable fastener can include a retaining feature configured to removably engage with a retainer aperture in the combustion liner. The retaining feature can include a pull tab clip extending from the fastener body to be moved to extend around the combustion liner flange or the nozzle to interact with the retainer aperture when released. In certain embodiments, the retaining feature can include push clips extending from the fastener body and configured to deform when the fastener is inserted into the slot and to extend into the retaining aperture when aligned therewith to removably retain the fastener.

In accordance with at least one aspect of this disclosure, a removable fastener for a combustion liner and fuel nozzle assembly can include a fastener body, one or more fastener flanges configured to be moved between a compressed state and a released state, and a channel defined in the fastener body that is configured to interact with a protrusion connected to a fuel nozzle or a combustion liner, wherein the fastener is configured to fit through a clip opening of a second flange which extends from a first flange of a combustion liner or fuel nozzle in the compressed state and to fit within a pocket defined between the second flange and a body in the released state to interact with the second flange and the body to retain the combustion liner to the fuel nozzle such that the combustion liner is longitudinally fixed relative to the fuel nozzle but such that the combustion liner can radially move relative to the fuel nozzle. The removable fastener can made of a same material as the combustion liner and/or fuel nozzle. Any other suitable material is contemplated herein.

These and other features of the systems and methods of the subject disclosure will become more readily apparent to those skilled in the art from the following detailed description taken in conjunction with the drawings.

In accordance with at least one aspect of this disclosure, a turbomachine component retaining arrangement can include a fuel nozzle defining a nozzle surface, the fuel nozzle having a plurality of protrusions extending axially from the nozzle surface, each of the plurality of protrusions having a head and a neck, the head having a larger radial dimension than the neck, a combustion liner having a combustor surface and a flange with a plurality of openings, the combustion liner being configured such that each of the plurality of axial protrusions extend through the flange through one of the plurality of openings when the combustor surface is axially abutted to the nozzle surface, and a plurality of clips engagable with the flange and the plurality of protrusions, each of the plurality of clips configured to engage with the neck and the head of each of the plurality of protrusions to axially retain each of the plurality of protrusions relative to the flange while allowing radial movement between the plurality of protrusions and the flange.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 3 is a perspective view of the embodiment of a fastener disposed in an embodiment of a combustion liner in accordance with this disclosure;

FIG. 4 is a perspective view of the embodiment of a fastener of FIG. 3;

DETAILED DESCRIPTION

Figure 1:
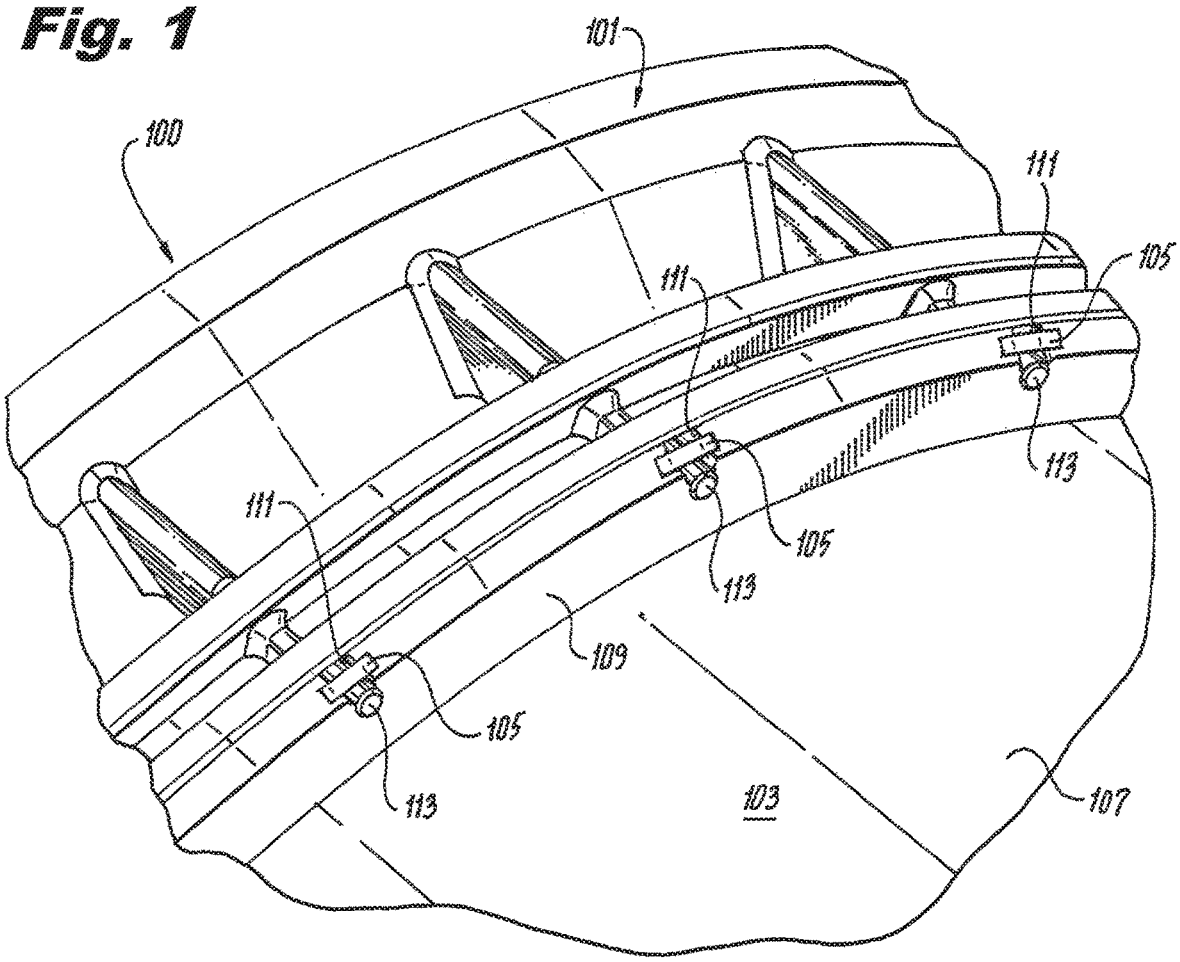
FIG. 1 is a perspective view of an embodiment of an assembly in accordance with this disclosure, showing an embodiment of a combustion liner connected to an embodiment of a fuel nozzle.

Reference will now be made to the drawings wherein like reference numerals identify similar structural features or aspects of the subject disclosure. For purposes of explanation and illustration, and not limitation, an illustrative view of an embodiment of an assembly in accordance with the disclosure is shown in FIG. 1 and is designated generally by reference character 100. Other embodiments and/or aspects of this disclosure are shown in FIGS. 2-8. The systems and methods described herein can be used to connect combustion liners to fuel nozzles, for example.

Figure 2:
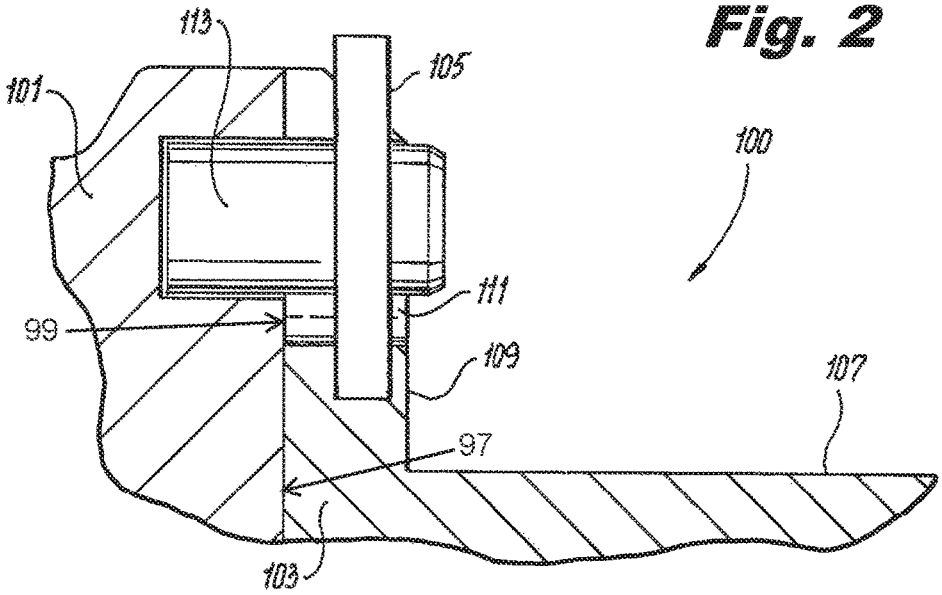
FIG. 2 is a cross-sectional view of a portion of the assembly of FIG. 1.

Referring to FIGS. 1 and 2, in accordance with at least one aspect of this disclosure, an assembly 100 for a turbomachine can include a fuel nozzle 101 and a combustion liner 103. The fuel nozzle 101 and the combustion liner 103 can be attached to each other using a plurality of clip joints 105 such that the combustion liner 103 is longitudinally fixed relative to the fuel nozzle 101 but such that the combustion liner 103 can radially move relative to the fuel nozzle 101.

In certain embodiments, the combustion liner 103 for a turbomachine can include a body 107 and a flange 109 extending from the body 107. The flange 109 can be configured to abut a fuel nozzle 101 of a turbomachine.

The flange 109 can include a plurality of protrusion openings 111 configured to receive a protrusion 113 extending from the nozzle 101 in an axial direction as shown, for example. Referring additionally to FIG. 3, the flange 109 can include a slot 315 defined at least partially circumferentially in an outer radius of the flange 109. It is contemplated that the slot 315 can be annular in certain embodiments, e.g., such that it is defined by two separate flanges). The slot 315 can be configured to receive a clip 417 that is configured to interact with the protrusion 113 to retain the flange 109 longitudinally to the nozzle 101 but to allow radial growth of the flange 109.

As appreciated by those having ordinary skill in the art in view of the disclosure, while certain embodiments are shown, the clip 417 can include any suitable features to retain the combustion liner 103 to the nozzle 101 such that the combustion liner 103 is longitudinally fixed relative to the fuel nozzle 101 but such that the combustion liner 103 can radially move relative to the fuel nozzle 101. As shown, the protrusion can include a bolt having a groove defined therein for interacting with the U-channel of the clip.

The assembly 100 can include the clip 417 disposed in the slot 315 and in connection with the protrusion 113 as shown, e.g., within a groove 316 of the protrusion 113. In certain embodiments, the combustion liner 103 can include a retainer aperture 319 configured to receive a retainer 421 of the clip 417 to retain the clip 421 to the combustion liner 103. The retainer aperture 319 can be defined in the flange 109 as shown and/or in any other suitable location and can include any suitable characteristics (e.g., shape, depth, size).

Referring additionally to FIG. 4, the clip 417 can be a removable fastener and can include a body 423 configured to fit within the slot 315 of the combustion liner flange 109 (or a flange of the nozzle 101 if the nozzle 101 and the liner 103 include a structurally reversed interface). The body 423 can define a channel 425 configured to receive a protrusion 113 which is fixed to the nozzle (or the combustion liner 103 in a structurally reversed interface). In certain embodiments, the channel can include a U-channel. For example, the U-channel can be sized to interact with the groove 316 at any radial position to retain the combustion liner 103 in the axial direction. Any other suitable channel characteristics are contemplated herein.

The clip 417 can include a retaining feature 421 configured to removably engage with a retainer aperture 319 in the combustion liner 103. The retaining feature can include a pull tab clip 427 extending from the fastener body 423. The pull tab clip 427 can be moved to extend around the combustion liner flange 109 (or the nozzle in a reverse structure) to interact with the retainer aperture 319 when released (as shown in FIG. 3).

Figure 5:
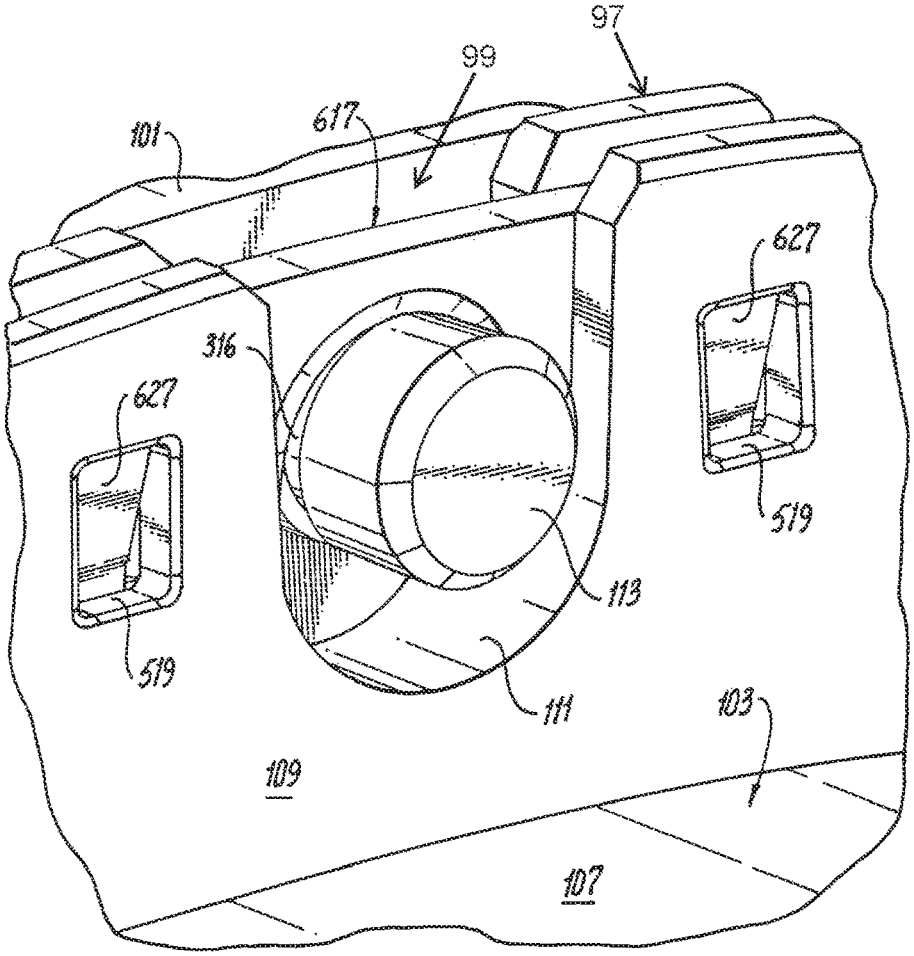
FIG. 5 is a perspective view of the embodiment of a fastener disposed in an embodiment of a combustion liner in accordance with this disclosure.
Figure 6:
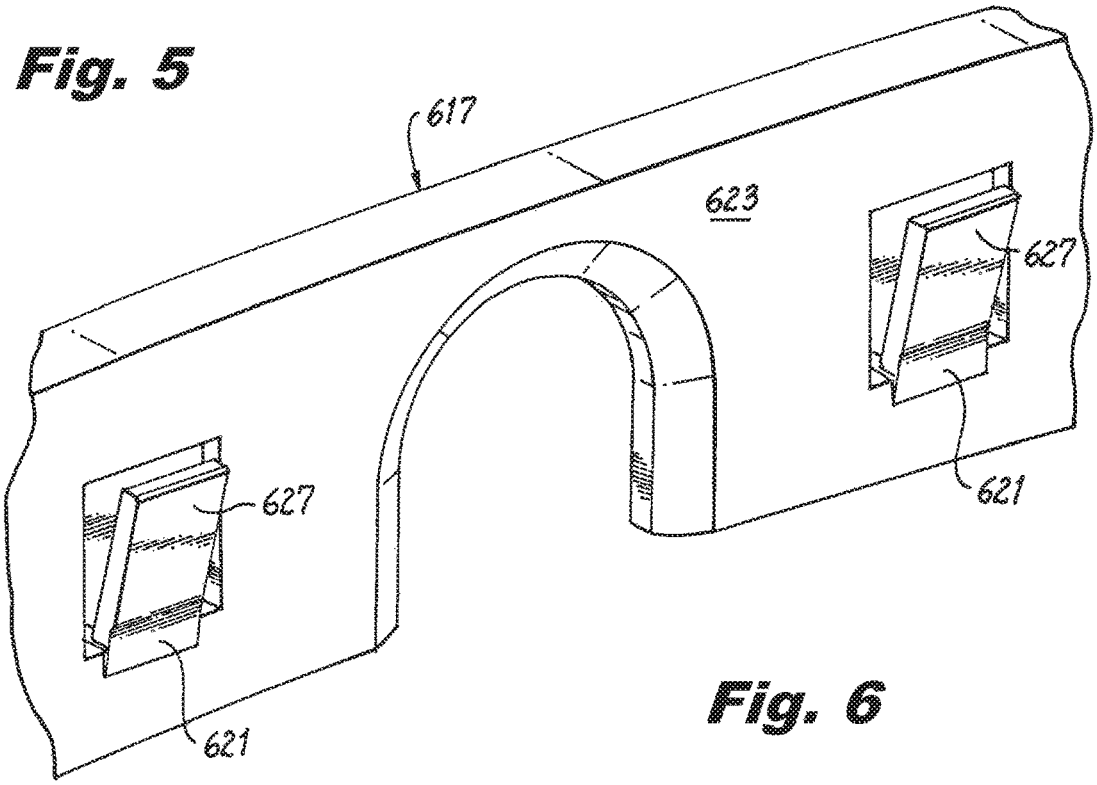
FIG. 6 is a perspective view of the embodiment of a fastener of FIG. 5.

Referring additionally to FIGS. 5 and 6, in certain embodiments, the retaining feature 621 can include push clips 627 extending from the fastener body 623. The push clips 627 can be configured to deform when the fastener 617 is inserted into the slot 315 and to extend into the retaining aperture 519 when aligned therewith to removably retain the fastener 617. While embodiments are shown and described, any other suitable retaining feature or combinations thereof are contemplated herein.

Figure 7:
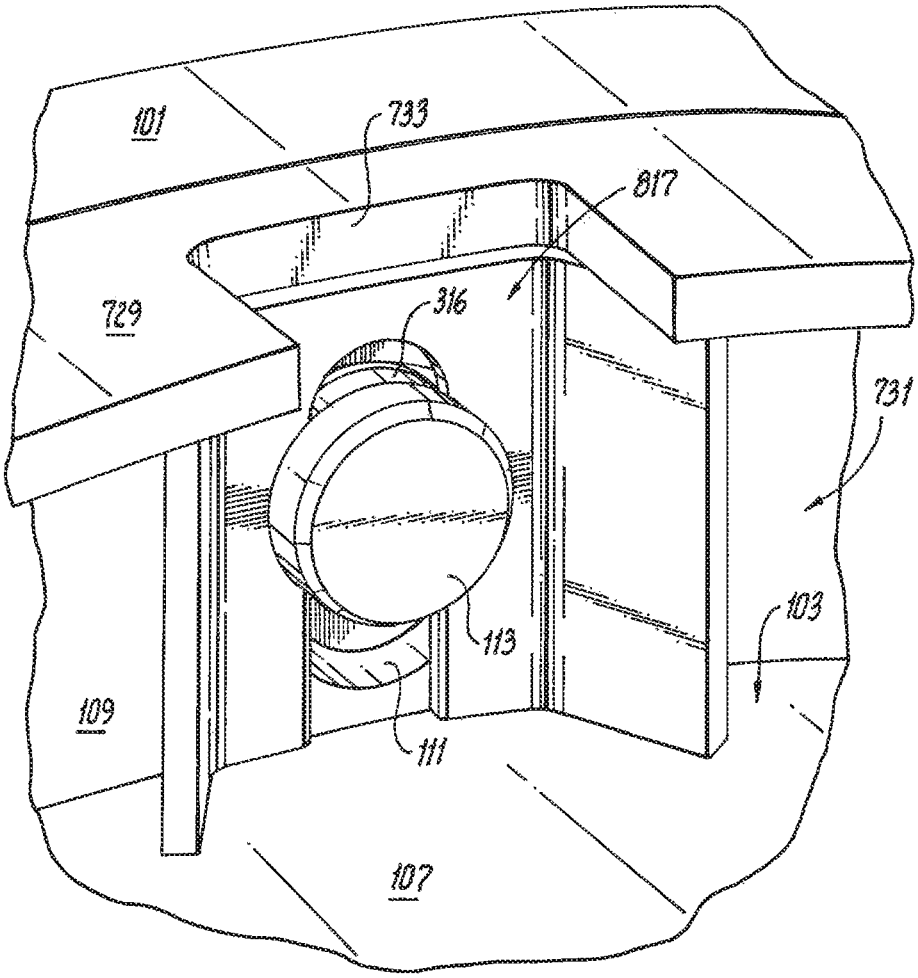
FIG. 7 is a perspective view of the embodiment of a fastener disposed in an embodiment of a combustion liner in accordance with this disclosure.
Figure 8:
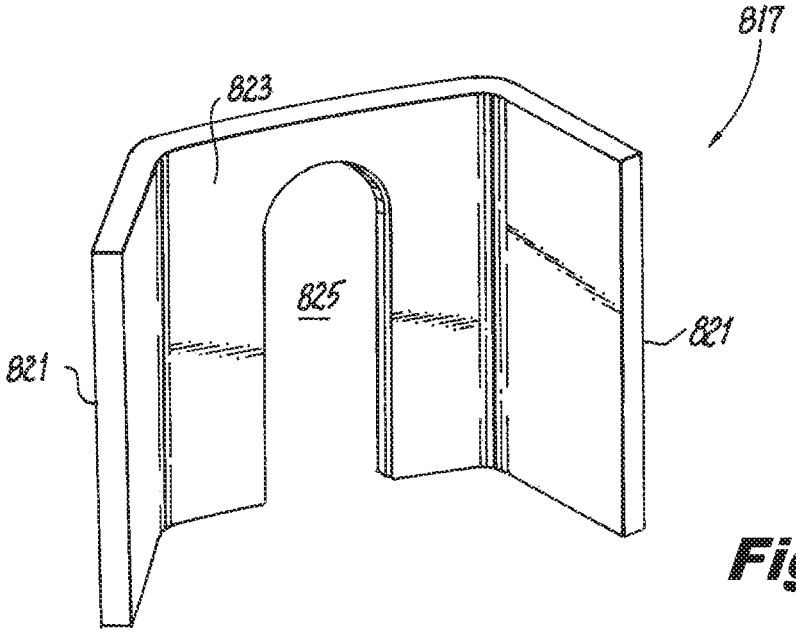
FIG. 8 is a perspective view of the embodiment of a fastener of FIG. 7.

Referring additionally to FIGS. 7 and 8, in certain embodiments, the combustion liner 103 can additionally include a second flange 729 extending at least partially longitudinally from the first flange 109 to define a pocket 731 between the second flange 729 and the body 107. The second flange 729 can include a plurality of clip openings 733 configured to allow a clip 817 to be inserted into the pocket 731 through each clip opening 733 to interact with the protrusion 113 to longitudinally retain the combustion liner 103 to the fuel nozzle 101. In such embodiments, the clip 817 can include a compressible shape such that the clip 817 can fit through each clip opening 733 in a compressed state. After being inserted and released, the clip 817 can retain itself within the pocket in the released state, e.g., as shown.

For example, as shown to FIG. 8, the clip 817 can be a removable fastener and can include a fastener body 823. One or more fastener flanges 821 can be defined by and/or can extend from the fastener body 823. The fastener flanges 821 can be configured to be moved between a compressed state and a released state (e.g., as shown in FIGS. 7 and 8). The body 823 also can define a channel 825 that is configured to interact with a protrusion 113 connected to the fuel nozzle 101 (or a combustion liner 103 in a reversed structure).

As described to above, the fastener 817 can be configured to fit through an opening (e.g., the clip openings 733) of a second flange 729 of the combustion liner 103 in the compressed state and to fit within the pocket 731 defined between the second flange 729 that extends from the first flange 109 in the released state. The clip 817 can interact with the second flange 729 to retain the combustion liner 103 to the fuel nozzle 101 such that the combustion liner is longitudinally fixed relative to the fuel nozzle 101 but also such that the combustion liner 103 can radially move relative to the fuel nozzle 101. The clip 817 can made of a same material as the combustion liner 103 and/or fuel nozzle 101. Any other suitable material is contemplated herein for the clip 817 and/or any other components described hereinabove.

In accordance with at least one aspect of this disclosure, a combustion liner for a turbomachine can include any suitable features, e.g., as described above. It is contemplated that the features of a combustion liner can be included in the fuel nozzle and/or reversed with those of the fuel nozzle as appreciated by those having ordinary skill in the art. For example, the combustion liner can include the protrusions and the nozzle may receive a clip for interacting with the protrusion.

In accordance with at least one aspect of this disclosure, a turbomachine component retaining arrangement can include a fuel nozzle defining a nozzle surface 99, the fuel nozzle having a plurality of protrusions extending axially from the nozzle surface 99, each of the plurality of protrusions having a head and a neck (e.g., a groove 316 as described above), the head having a larger radial dimension than the neck. The arrangement can include a combustion liner having a combustor surface 97 and a flange with a plurality of openings, the combustion liner being configured such that each of the plurality of axial protrusions extend through the flange through one of the plurality of openings when the combustor surface 97 is axially abutted to the nozzle surface 99. The arrangement can include plurality of clips engagable with the flange and the plurality of protrusions, each of the plurality of clips configured to engage with the neck (e.g., the groove 316) and the head of each of the plurality of protrusions to axially retain each of the plurality of protrusions relative to the flange while allowing radial movement between the plurality of protrusions and the flange.

Embodiments include quick connect clips and/or pads that replace the need for complex threaded joints. Embodiments of fasteners can slide into a groove and act similarly to a retainer ring, or snap ring and can retain the liner axially and radially as needed for operation. Embodiments reduce risk of the joint failure during operation and parts falling down stream in the engine.

The methods and systems of the present disclosure, as described above and shown in the drawings, provide for combustion liner/nozzle assemblies and fasteners with superior properties. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. An assembly for a turbomachine, comprising: a fuel nozzle having a plurality of axially extending protrusions; and a combustion liner, wherein the fuel nozzle and the combustion liner are attached to each other using a plurality of clip joints such that the combustion liner is longitudinally fixed relative to the fuel nozzle but such that the combustion liner can radially move relative to the fuel nozzle, wherein the combustion liner comprises: a body; and a flange radially extending from the body and configured to abut the fuel nozzle, wherein the flange includes: a plurality of protrusion openings configured to receive a respective protrusion of the plurality of protrusions extending axially from the nozzle; and a slot defined at least partially circumferentially in an outer radius of the flange, the slot configured to receive a clip that is configured to interact contact the protrusion to retain the flange longitudinally to the nozzle but to allow radial growth of the flange.

2. The assembly of claim 1, further comprising the dip disposed in the slot and in connection with the protrusion.

3. The assembly of claim 2, wherein the combustion liner further includes a retainer aperture configured to receive a retaining feature of the clip to retain the clip to the combustion liner.

4. The assembly of claim 3, wherein the retaining feature is configured to removably engage with the retainer aperture.

5. The assembly of claim 3, wherein the retainer aperture is defined in the flange.

6. The assembly of claim 2, wherein the clip includes a U-channel configured to receive the protrusion.

7. The assembly of claim 6, wherein the protrusion includes a bolt having a groove defined therein for interacting with the U-channel of the clip.

8. The assembly of claim 1, wherein the combustion liner includes:

a body;

a first flange extending from the body and configured to abut a fuel nozzle of a turbomachine the fuel nozzle having a plurality of protrusions, wherein the first flange includes a plurality of protrusion openings configured to receive a respective protrusion extending from the nozzle; and a second flange extending at least partially longitudinally from the first flange to define a pocket between the second flange and the body, wherein the second flange includes a plurality of clip openings configured to allow a clip to be inserted into the pocket through each clip opening to interact with the protrusion to longitudinally retain the combustion liner to the fuel nozzle.

9. The assembly of claim 8, further comprising the clip, wherein the clip includes a compressible shape such that the clip can fit through each respective clip opening in a compressed state and retains the respective clip in the pocket in the released state.

10. The assembly of claim 9, further comprising a removable fastener including:

a fastener body; and one or more fastener flanges configured to be moved between a compressed state and a released state; and a channel defined in the fastener body that is configured to interact with the protrusion connected to a fuel nozzle or a combustion liner, wherein the fastener is configured to fit through the clip opening of a second flange which extends from a first flange of a combustion liner or fuel nozzle in the compressed state and to fit within the pocket defined between the second flange and the body in the released state to interact with the second flange and the body to retain the combustion liner to the fuel nozzle such that the combustion liner is longitudinally fixed relative to the fuel nozzle but such that the combustion liner can radially move relative to the fuel nozzle.

11. The assembly fastener of claim 10, wherein the removable fastener is made of a same material as the combustion liner and/or fuel nozzle.

12. A turbomachine component retaining arrangement, comprising:

a fuel nozzle defining a nozzle surface, the fuel nozzle having a plurality of protrusions extending axially from the nozzle surface, each of the plurality of protrusions having a head and a neck, the head having a larger radial dimension than the neck;

a combustion liner having a combustor surface and a flange with a plurality of openings, the combustion liner being configured such that each of the plurality of axial protrusions extend through the flange through one of the plurality of openings when the combustor surface is axially abutted to the nozzle surface; and a plurality of clips engagable with the flange and the plurality of protrusions, each of the plurality of clips configured to engage with the neck and the head of each of the plurality of protrusions to axially retain each of the plurality of protrusions relative to the flange while allowing radial movement between the plurality of protrusions and the flange wherein each clip is disposed in a slot and in connection with a respective protrusion, wherein each clip includes a U-channel configured to receive the respective protrusion.

* * * * *